US005649789A

United States Patent [19]

Denz

[11] Patent Number: 5,649,789

[45] Date of Patent: Jul. 22, 1997

[54] INTEGRATED DRILLING AND ROCK BOLTING APPARATUS

[75] Inventor: Kieron Denz, Belmont North, Australia

[73] Assignee: Cutincoal PTY Limited, New South Wales, Australia

[21] Appl. No.: 513,889

[22] PCT Filed: Apr. 11, 1994

[86] PCT No.: PCT/AU94/00177

§ 371 Date: Aug. 31, 1995

§ 102(e) Date: Aug. 31, 1995

[87] PCT Pub. No.: WO94/24404

PCT Pub. Date: Oct. 27, 1994

[30] Foreign Application Priority Data

Mar. 16, 1993 [AU] Australia ..... PL8343

[51] Int. Cl.[6] ..... E21D 20/00

[52] U.S. Cl. ..... 405/259.1; 52/698

[58] Field of Search ..... 405/259.1, 259.5, 405/259.6; 52/698, 704

[56] References Cited

U.S. PATENT DOCUMENTS

| | | | |
|---|---|---|---|
| 747,219 | 12/1903 | Preslar | 405/259.1 X |
| 1,098,250 | 5/1914 | Gonia | 52/698 X |
| 1,996,121 | 4/1935 | Phillips | 52/698 X |
| 2,351,449 | 6/1944 | Noble | 405/259.1 X |
| 2,771,746 | 11/1956 | Fischer et al. | 405/259.1 |
| 4,334,392 | 6/1982 | Dziedzic | 405/259.1 X |
| 4,946,314 | 8/1990 | Gruber | 405/259.1 X |

FOREIGN PATENT DOCUMENTS

| | | |
|---|---|---|
| 815633 | 10/1951 | Germany . |
| 748969 | 9/1953 | United Kingdom . |

*Primary Examiner*—Dennis L. Taylor
*Attorney, Agent, or Firm*—Howson and Howson

[57] ABSTRACT

Integrated drilling and rock bolting member having a threaded end and a distal end with the threaded end connectable to a rotational drive device and the distal end having formed therein a transverse slot which extends longitudinally through the distal end and terminates adjacent the threaded end. The bolt member having opposed inclined wedge faces along a portion of the slot adjacent the distal end. A drilling element having opposed wedge shaped faces which mate with the wedge shaped faces of the bolt member. The drilling element being connected in the slot. In the drilling mode the connection transmits torque and prevents axial displacement between the bolt member and the drill element and in the anchoring mode permits relative axial displacement between the drilling element and the bolt member in response to a predetermined threshold axial force component applied to the bolt member whereby the relative axial displacement secures the bolt member within the hole.

11 Claims, 5 Drawing Sheets

INTEGRATED DRILLING AND ROCK BOLTING APPARATUS

The present invention relates to a rock bolting apparatus.

The invention has been developed particularly for use in stabilising roofs and sides or ribs in underground mining operations and will be described hereinafter with reference to this application. However, it will be appreciated that the invention is not limited to this field of use.

The conventional prior art technique of fixing bolts in a rock substrate involves first drilling a hole several feet into the rock. The drill shaft and bit are then retracted and a correspondingly sized rock bolt installed in the usual manner.

This operation is relatively labour intensive and time consuming. Furthermore, the rock formation is often inherently unstable in mines and excavations making the drilling operation potentially dangerous. The prior art technique is also difficult and expensive to automate because of the number of separate operations required.

It is an object of the present invention to overcome or at least ameliorate one or more of the above discussed disadvantages of the prior art.

According to the invention there is provided an integrated self drilling rock bolting apparatus comprising:

a bolt having a drilling element located at one end, said bolt having a threaded end and a transverse slot extending from the other end thereof and terminating adjacent said threaded end, said slot having a free end and opposed inclined wedge faces adjacent its free end, said drilling element having a proximal end secured in said slot by connection means and having opposed wedge shaped faces forming a wedge shaped section at the proximal end which mates with the wedge faces in said slot, said bolt being connectable at its opposite end to rotational drive means;

connection means operable in a drilling mode to transmit torque and prevent relative axial displacement between the drilling element and the bolt whereby the drilling element is adapted to bore a hole in a substrate upon conjoined rotation of said bolt by said drive means, said connection means being subsequently operable in an anchoring mode to permit relative axial displacement between the drilling element and the bolt in response to a predetermined threshold axial force component applied to said bolt; and retaining means operable in response to said relative axial displacement to secure said bolt within said hole.

In one preferred form, the retaining means comprises a longitudinally extending slot adapted to divide one end of the bolt into two complimentary halves, and a complementary wedge member associated with the proximal end of the drilling element. In the anchoring mode the wedge member urges the complimentary halves of the bolt outwardly into locking engagement with the surrounding substrate.

In a variation of this embodiment, the drilling element incorporates a multiplicity of interconnected longitudinally extending wedge sections nestingly disposed within correspondingly configured segments defined between the divided end portions of the bolt. In this way, the bolt can be expanded and anchored over its entire length, or over discrete sections of its length to enhance anchorage characteristics.

The bolt and drilling element in a preferred form of the invention are formed integrally and connected by fracturable connection means to temporarily connect these components in the drilling mode. Under the predetermined axial load conditions, the fracturable connections means are subsequently broken to initiate the anchoring mode whereby the so divided bolt portions are driven into expanding engagement with the wedge member, thereby progressively forcing the bolt portions outwardly into engagement with the surrounding substrate.

In a modification an axial bore extends throughout the length of the apparatus and longitudinal grooves extend on either side of the bore in the bolt but spaced therefrom to a fracturable connection.

In a further modification the bolt and drill are formed as separate units and connection by one or more shear pins extending transversely through the wedge member and the surrounding divided bolt portions. The shear pins operate in the same manner as the fracturable connection means described.

In another preferred form, the retaining means comprises a frangible capsule of chemical adhesive adapted to be ruptured by the relative axial displacement of the bolt upon application of the predetermined axial load in the anchoring mode. In this way, the adhesive spreads around the bolt to secure it within the surrounding rock.

In this embodiment, the connection means preferably comprises a sleeve disposed intermediate the bolt and the drilling element. The sleeve is preferably joined to the bolt by connection means in the form of a fracturable section or a shear pin extending transversely through the end of the bolt and a surrounding portion of the sleeve.

Preferably, the drilling element is rigidly connected with the other end of the sleeve and the frangible capsule of adhesive thereby located in an intermediate space defined within the sleeve. Under the application of the predetermined axial load, the fracturable section or shear pin is again broken to permit axial displacement of the bolt toward the drilling tip. This displacement ruptures the frangible capsule thereby causing the adhesive to disperse over the end of the sleeve and around the bolt.

In both embodiments, the bolt is preferably adapted for connection to selectively operable rotational drive means by virtue of a square section head engageable by a corresponding square chuck.

It is also preferred that the drilling element comprises a tungsten carbide or hardened tip and an adjacent twisted or fluted shank portion to direct tailings away from the tip.

Desirably, the bolt also includes a threaded portion adjacent its driven end to facilitate connection of support plates and the like to help stabilise the substrate in the immediate vicinity of the bolt.

Preferred embodiments of the invention will now be described, by way of example only, with reference to the accompanying drawings in which.

Figure 1:
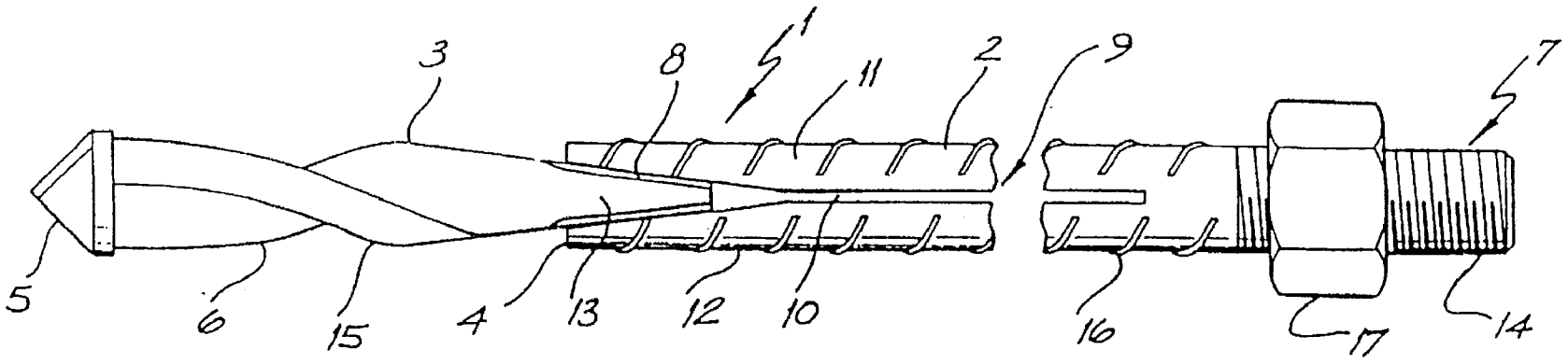
FIG. 1 is a schematic side view of the bolt portion and drilling element of an apparatus according to a first embodiment of the invention.
Figure 4:
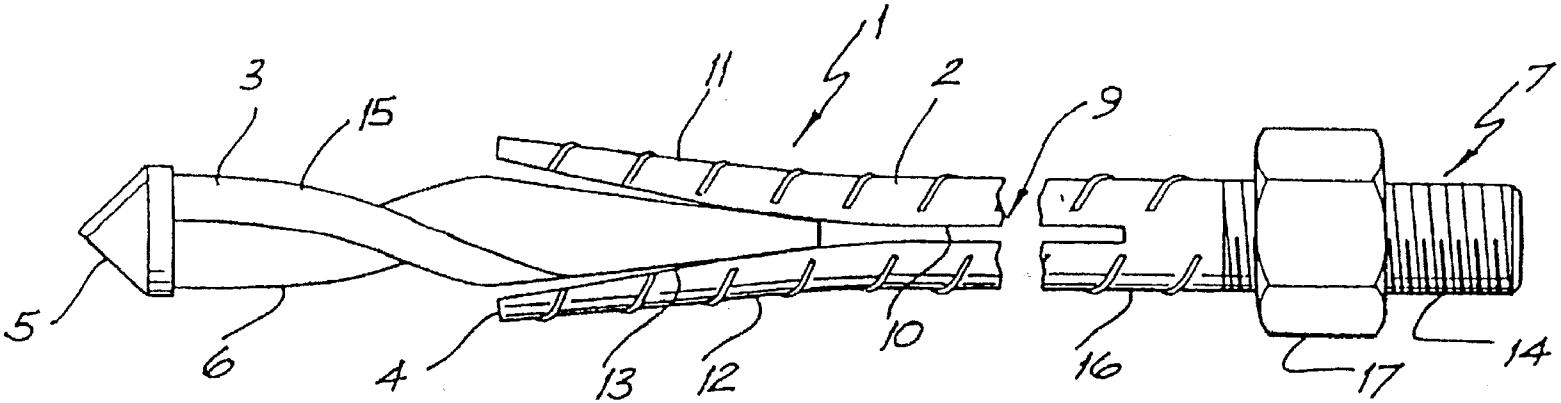
FIG. 4 is a schematic view of the first embodiment of the bolt assembly in the expanded or anchoring mode.

Referring firstly to FIGS. 1 and 4, a first embodiment of the invention provides an expanding type rock bolt assembly.

The self-drilling rock bolting apparatus 1 comprises a bolt 2 supporting a drilling element 3 located adjacent a first end 4 of the bolt. The drilling element includes a cutting head 5 which may have a tungsten carbide or other suitable tip supported on the terminal end of a shank 6.

The bolt 2 is connectable at its other end 7 for connection to selectively operable rotational drive means engageable by a corresponding chuck (not shown). Of course, it will be appreciated that any other suitable engagement means such as chemical nuts may also be used. The bolt 2 also includes a threaded portion 14 adjacent its driven end 7.

The apparatus 1 also includes retaining means shown generally at 9. In this first embodiment, the retaining means includes an open ended longitudinally extending slot 10 formed in the first end 4 of the bolt. The slot defines two opposing bolt portions 11 and 12. Also forming part of the retaining means 9 is a wedge section 13 formed in the corresponding end 14 of the drilling element 3.

Figure 2:
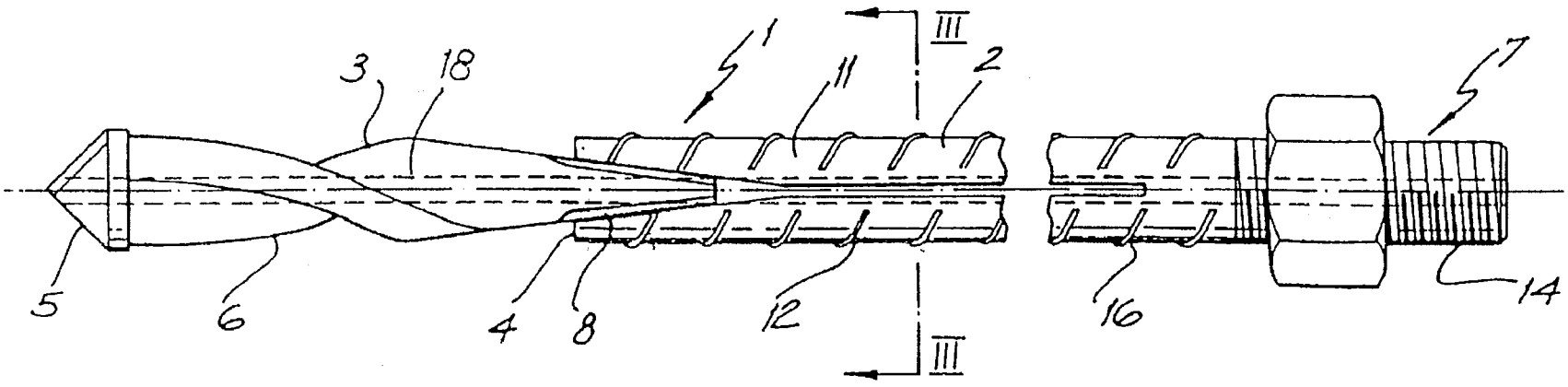
FIG. 2 is a schematic side view of the bolt portion and drilling element according to a second embodiment of the invention.
Figure 3:
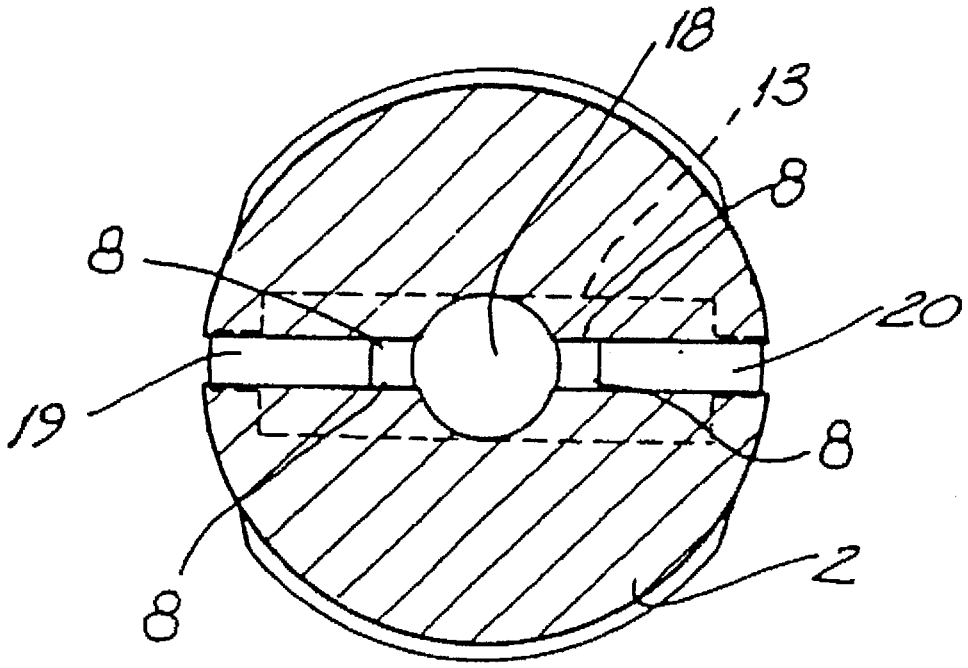
FIG. 3 is a cross-sectional view through line 2—2 of FIG. 2.

According to the embodiments of the invention illustrated in FIGS. 1, 2 and 3 the bolt 2 and drilling element 3 are formed integrally and the connection means comprises a fracturable section 8 interconnecting the shank 6 with the bolt 2.

Desirably, the drill shank 5 and bolt 2 are twisted or grooved to provide helical flutes 15 and 16.

In use, the apparatus 1 is preferably connected with drive means, adapted selectively to operate in either a predominantly rotational drilling mode or, alternatively, an axially directed impact mode as described in more detail below.

At the first stage of the operation, in the drilling mode, rotational drive is selected and applied to the end 7. The torque applied is transferred through the bolt 2, via the transverse the fracturable section 8, to the drilling element 3. As the cutting head 5 bores into the rock substrate, the tailings are directed out of the hole by the helical flutes 15 and 16.

Once the assembly has been drilled to the requisite depth in the rock, the impact drive mode is selected and a predetermined threshold axial load thereby applied to the exposed end of the bolt. This axial loading causes the fracturable section 8 to break, which in turn initiates the anchoring mode by driving the bolt 2 inwardly relative to the stationary tip 3 abutting the blind end of the hole. This causes the divided bolt portions 11 and 12 to advance over the intermediate wedge section 13, thereby expanding the bolt portions outwardly into locking engagement with the surrounding rock.

Once the apparatus is thus retained, securing plates or the like can be connected with the exposed end portion 14 of the bolt and located by a correspondingly threaded nut 17 in the usual manner to stabilise the region of the rock substrate surrounding the bolt.

FIGS. 2 and 3 illustrate a modification of the apparatus illustrated in FIG. 1. The apparatus is identical with that illustrated in FIG. 1 except an axial bore 18 extends throughout the length of the apparatus and longitudinal grooves 19 20 and extend on either side of the bolt 2, the area between the bore and the grooves constituting the fracturable section 8 as illustrated is FIG 3. The purpose of the axial bore 18 is to permit passage of a lubricant and/or an adhesive composition to drilling element 3.

Figure 5:
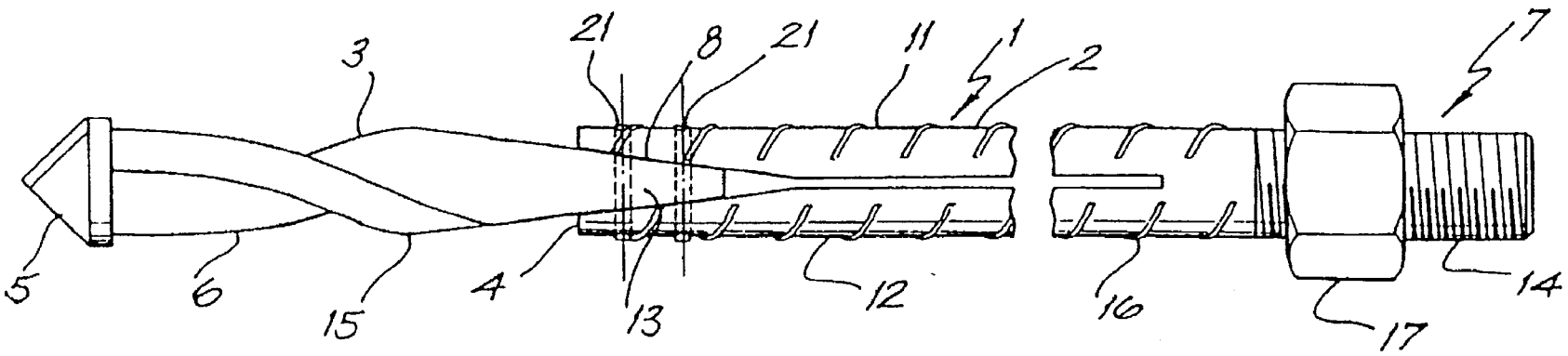
FIG. 5 is a schematic side view of the bolt portion and drilling element according to a third embodiment of the invention.

FIG. 5 shows a variation of the fracturable connection means. In the case of this embodiment the parts are identical with those illustrated in FIG. 1 except the fracturable connection means comprise shear pins 21 which interconnect the shank 6 of the drilling element with the first end 4 of the bolt.

Figure 6:
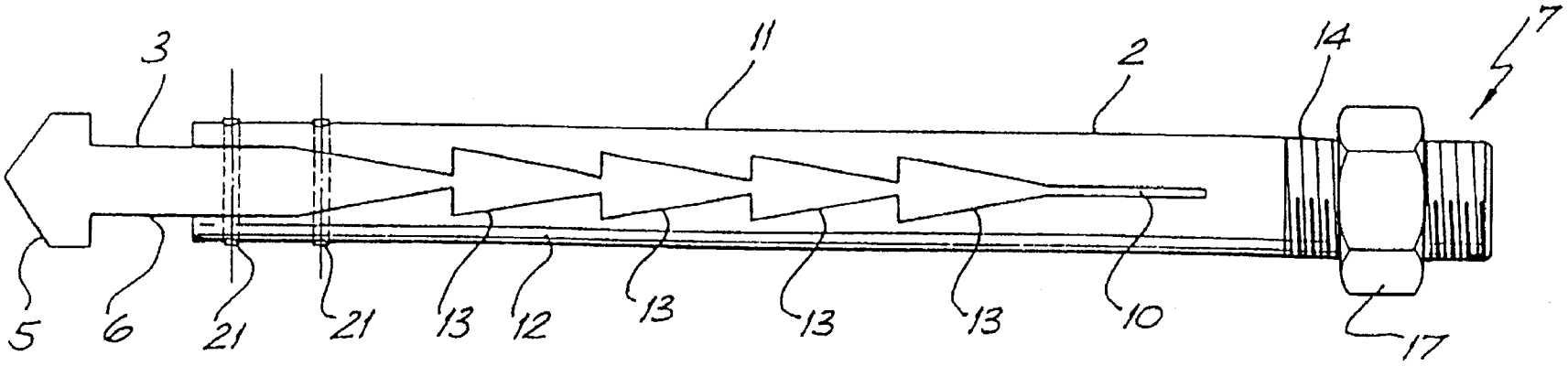
FIG. 6 is a diagrammatic side elevation showing a fourth embodiment of the invention wherein the drilling element incorporates a series of longitudinally spaced wedge formations adapted to provide extended anchorage over corresponding longitudinal sections of the bolt.

FIG. 6 shows a variation on the first embodiment which has been developed for use in applications involving relatively soft or unstable roofs or ribs where simple point anchorage may not be sufficient. In this embodiment, the drilling element incorporates a series of longitudinally spaced apart wedge sections 13 disposed within correspondingly configured formations defined between the surrounding bolt portions 12. It will be appreciated that this variation works in substantially the same way as the embodiments previously described. In this case, however, the longitudinally spaced apart wedge formations are adapted to expand the bolt over the majority of its entire length. In this way, if the bolt passes through soft strata, a more secure anchorage will be obtained. Likewise, if both stable and unstable strata are encountered, effective anchorage will be achieved through the more stable strata.

A further variation of this embodiment (not shown) incorporates discrete longitudinal anchorage sections interspersed with non-expanding bolt sections so that if appropriate, the expanding section could be tailored for optimum engagement with specific configurations of stable and unstable rock strata.

Thus, with a combination of the embodiments described above, bolts providing anchorage, full length anchorage, or any intermediate configuration may be selected to provide the requisite degree of anchorage, subject to the particular configuration and type of roof strata.

Figure 7:
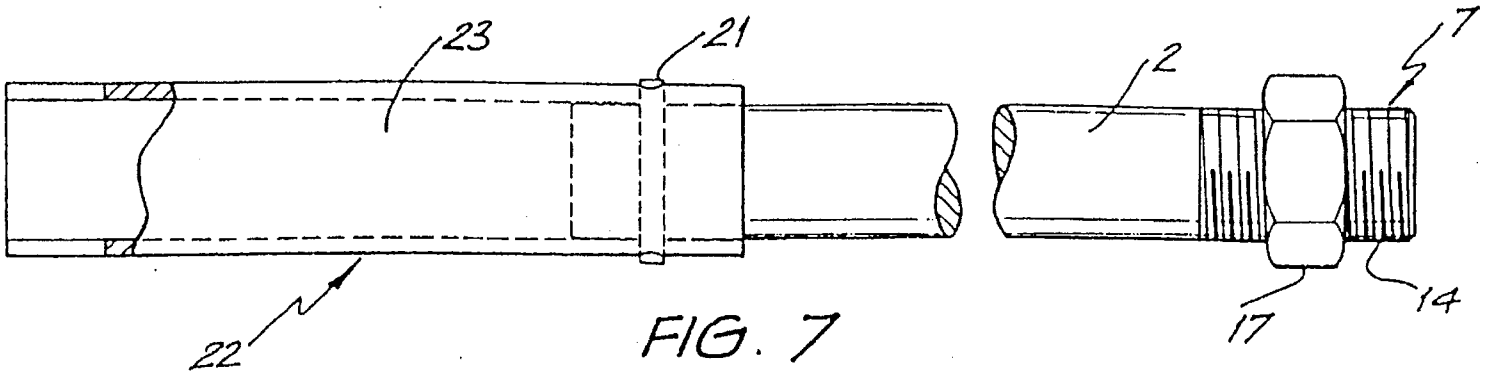
FIG. 7 is a schematic side view of the bolt and connecting means according to a fifth embodiment of the invention.
Figure 8:
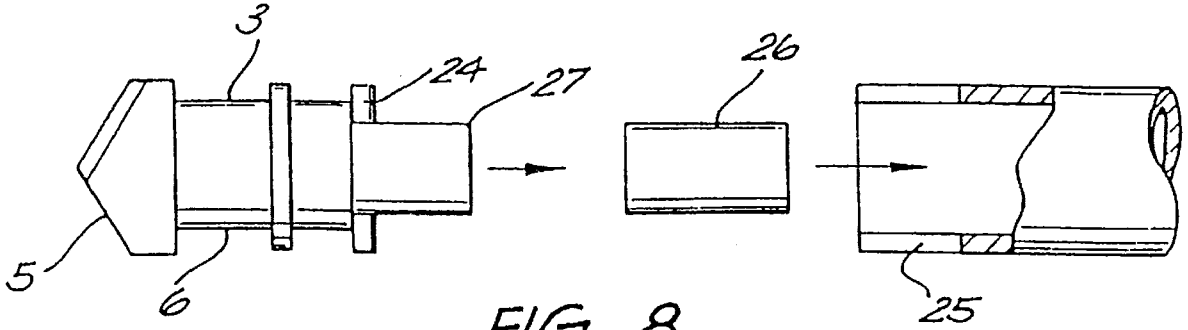
FIG. 8 is an exploded schematic view of the drilling element, adhesive capsule and surrounding sleeve adapted for connection to the bolt as shown in FIG. 7.
Figure 9:
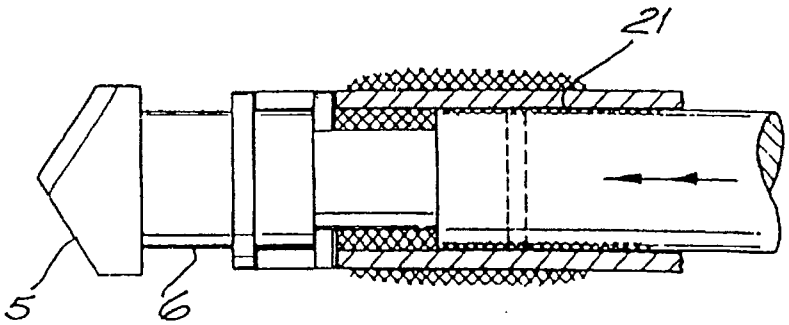
FIG. 9 is a schematic partly sectioned side elevation of the apparatus of FIGS. 7 and 8 shown in the secured or anchored position following rupture of the adhesive capsule.

Referring next to FIGS. 7, 8 and 9, a fifth embodiment of the invention will now be described. Where possible, like reference numerals are used to denote corresponding features.

Again, the apparatus 1 comprises a bolt 2 connected to a drilling element shown generally at 3. The drilling element also includes at its free end a cutting head 5 with an appropriate tip.

The drilling element 3 is similarly connected to the first end 4 of the bolt 2 by connecting means shown generally at 22.

In this instance, however, the retaining means takes the form of a tubular outer sleeve 23. This sleeve is connected by suitable key formations 24 disposed on the drilling element to cooperate with corresponding slots 25 provided in the surrounding sleeve. The other end of the sleeve is connected with the bolt 2 by fracturable means, again in the form of shear pin 21.

Located in a complementary space or void within the sleeve 23 is a frangible capsule of fast curing chemical adhesive 26. The capsule is thereby disposed axially between the first end 4 of the bolt and the adjacent end 27 of the drilling element 3.

In use, the apparatus is drilled into the rock in the same manner as the previous embodiments, until the bolt is located at the requisite depth.

Once more, the rotational drive is then disengaged and the axially directed impact drive selected. On application of the impact force the shear pin 21 again fractures, to initiate the anchoring mode whereby the bolt 2 is displaced axially toward the drilling element 3 which is located in abutment with the blind end of the hole. At the same time, the sleeve is permitted to drop down the bolt shaft.

Thus, the bolt forces the frangible adhesive capsule 26 against the shank of the drilling element, causing the capsule to rupture. Further displacement causes the adhesive to disperse around the end of the sleeve, thereby pushing the sleeve part way down the bolt shaft if it is not already dropped down to a sufficient extent to permit free dispersal of the adhesive. The chemical adhesive then partially encapsulates the bolt, securing it in position within the surrounding rock.

It will be appreciated that this embodiment is particularly suitable for use in unstable rock types which may be prone to cracking or breaking away should an expanding-type bolt be used.

Whilst the preferred embodiments described incorporate frangible sections and shear pins as the connection and torque transmission means, alternative embodiments may incorporate, for example, clutching or other mechanisms which may be disengaged, decoupled or fractured to permit axial displacement upon application of the predetermined axial load to actuate the retaining means.

Furthermore, although the use of a single variable mode drive means is preferred, particularly when contemplating automation of the process, separate rotational and impact drive means can also be employed.

It is also contemplated that the drilling element could be composed of alternative materials such as fibreglass or even suitable plastics which would allow the steel bolt portion to be removed when no longer required, and reused with fresh disposable tips.

It will be seen that the apparatus of the present invention dramatically reduces the installation time by obviating the need for separate drilling and bolt installation steps. In addition, the integrated drilling/bolting assemblies can be conveniently stored in magazines, which readily lend themselves to automated installation by remotely operable special purpose bolting machines. In addition to the obvious commercial benefits, this facility has significant implications in terms of mine safety, since with remote operation dust in the vicinity of the drilling operation would no longer be so critical and the loss of human life in the event of cave-ins would also be minimised.

Although the invention has been described with reference to specific examples, it will be appreciated by those skilled in the art that the invention may be embodied in many other forms.

I claim:

1. Integrated drilling and rock bolting apparatus comprising a bolt member and a drilling element located at one end, said bolt having a threaded end and a transverse slot extending from the other end thereof and terminating adjacent said threaded end, said slot having a free end and opposed inclined wedge faces adjacent its free end, said drilling element having a proximal end secured in said slot by connection means and having opposed wedge shaped faces forming a wedge shaped section at the proximal end which mates with the wedge faces in said slot, said bolt being connectable at its opposite end to rotational drive means, said connection means being operable in a drilling mode to transmit torque and prevent axial displacement between the bolt member and drilling element whereby the drilling element is adapted to bore a hole in a substrate upon conjoined rotation of said bolt by said drive means; said connection means being subsequently operable in an anchoring mode to permit relative axial displacement between the drilling element and the bolt in response to a predetermined threshold axial force component applied to the bolt and retaining means operable in response to said axial displacement to secure the bolt within said hole.

2. Integrated drilling and rock bolting apparatus as claimed in claim 1 wherein the connection means is provided between the longitudinally extending transverse slot in one end of the bolt and the wedge shaped section on the proximal end of the drilling element.

3. Integrated drilling and rock bolting apparatus as claimed in claim 2 wherein said bolt and the drilling element are formed integrally and the connection between the wedge shaped section and the bolt comprises a fracturable section.

4. Integrated drilling and rock bolting apparatus as claimed in claim 2 wherein said bolt and drilling element are formed separately and the connection between the wedge shaped section and the bolt comprises at least one shear pin passing through said wedge shaped section and said bolt.

5. Integrated rock drilling and rock bolting apparatus as claimed in claim 1 wherein said rock bolt and the drilling element are formed integrally with an axial bore extending throughout the length of said apparatus and a longitudinal groove extending from the end of said bolt proximate said drilling element on either side of said bolt, the area between said bore and said grooves constituting a fracturable section whereby when said section is broken in said anchoring mode, the longitudinally extending transverse slot having opposed limbs is formed in said bolt which engages the wedge shaped section on the end of said drilling element whereby in said anchoring mode the limbs of said slot are forced apart to secure said bolt within said hole.

6. Integrated rock drilling apparatus as claimed in claim 2 wherein said slot is wedge shaped adjacent its free end to conform with the shape of the proximal end of the drilling element.

7. Integrated drilling and rock bolting apparatus as claimed in claim 2 wherein the drilling element incorporates a multiplicity of interconnected, longitudinally extending wedge sections nestingly disposed within corresponding configured segments in the slot between bifurcated end sections of the bolt.

8. Integrated drilling and rock bolting apparatus as claimed in claim 1 wherein the bolt includes a threaded section at its threaded end to accommodate support plates and a nut.

9. Integrated drilling and rock bolting apparatus as claimed in claim 1 wherein the drilling element and the bolt have shanks which are twisted or grooved to provide helical flutes.

10. Integrated rock drilling apparatus as claimed in claim 5 wherein said slot is wedge shaped adjacent its free end to conform with the shape of the proximal end of the drilling element.

11. Integrated drilling and rock bolting apparatus comprising:

a bolt member having a threaded end and a distal end, said threaded end connectable to a rotational drive means, said distal end having formed therein a transverse slot which extends longitudinally through said distal end and terminates adjacent said threaded end, said bolt member having opposed inclined wedge faces along a portion of said slot adjacent said distal end;

a drilling element having opposed wedge shaped faces which mate with said wedge shaped faces of said bolt member; and connection means for securing said drilling element in said slot;

said connection means operable in a drilling mode to transmit torque and prevent axial displacement between said bolt member and said drilling element whereby said drilling element is adapted to bore a hole in a substrate upon conjoined rotation of said bolt member by the rotational drive means; and said connection means being subsequently operable in an anchoring mode to permit relative axial displacement between said drilling element and said bolt member in response to a predetermined threshold axial force component applied to said bolt member whereby the relative axial displacement secures said bolt member within the hole.

* * * * *